US005519911A

United States Patent [19]

Callander

[11] Patent Number: 5,519,911

[45] Date of Patent: May 28, 1996

[54] HEADLIGHT CLEANER WITH COMBINED SQUEEGEE AND BRUSH

[76] Inventor: Richard J. Callander, 8504 - 11 St. S.W., Calgary, Alberta, Canada, T2V 1N6

[21] Appl. No.: 387,176

[22] Filed: Feb. 13, 1995

[51] Int. Cl.[6] ..... A47L 1/08; A47L 23/04

[52] U.S. Cl. ..... 15/114; 15/117; 15/121; 15/245; 15/176.3; 15/176.1; 15/145

[58] Field of Search ..... 15/121, 111, 117, 15/118, 245, 176.1, 176.2, 176.3, 176.4, 176.5, 176.6, 145, 106, 159.1, 160, 114

[56] References Cited

U.S. PATENT DOCUMENTS

| | | | |
|---|---|---|---|
| 898,316 | 9/1908 | Carlson | 15/117 |
| 1,073,034 | 9/1913 | Ford | 15/145 |
| 2,446,401 | 8/1948 | Ziskind | 15/121 |
| 2,936,469 | 5/1960 | Eklind | 15/121 |
| 3,001,219 | 9/1961 | Miller | 15/121 |
| 3,017,649 | 1/1962 | Racicot | 15/111 |
| 3,094,728 | 6/1963 | White | 15/145 |
| 3,110,052 | 11/1963 | Whitman | 15/245 |
| 3,724,017 | 4/1973 | Mallory | 15/121 |
| 3,968,535 | 7/1976 | Nichols | 15/121 |
| 4,107,812 | 8/1978 | Lantto | 15/245 |
| 4,398,839 | 8/1983 | Kluck | 15/245 |
| 4,908,900 | 3/1990 | McLaughlin et al. | 15/160 |
| 4,993,101 | 2/1991 | Newman, Sr. et al. | 15/145 |
| 5,313,683 | 5/1994 | Dickie et al. | 15/117 |

FOREIGN PATENT DOCUMENTS

| | | | |
|---|---|---|---|
| 7363 | of 1892 | United Kingdom | 15/117 |

*Primary Examiner*—Gary K. Graham

[57] ABSTRACT

A headlight cleaner for a vehicle including a brush head; a brush handle having a tip end coupled to the brush head, a base end, and a bend therebetween to thereby define a straight short segment and a straight long segment; a straight squeegee handle having a tip end and a base end coupled to the base end of the brush handle; and an elongated squeegee coupled to the tip end of the squeegee handle.

1 Claim, 3 Drawing Sheets

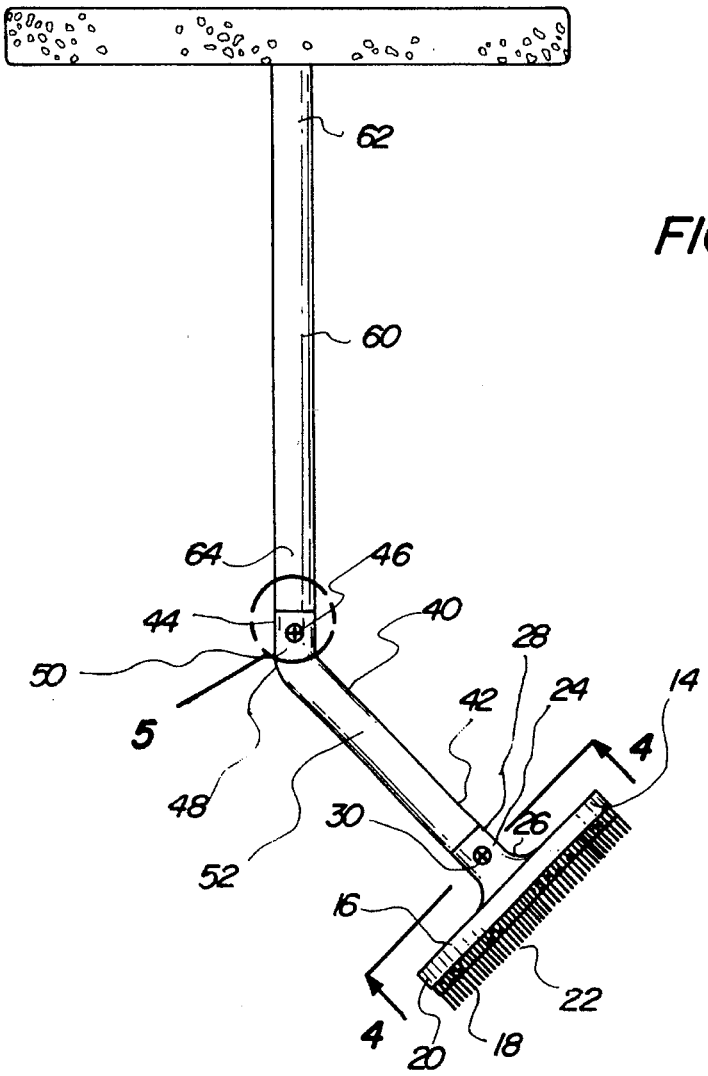
FIG. 3
FIG. 4
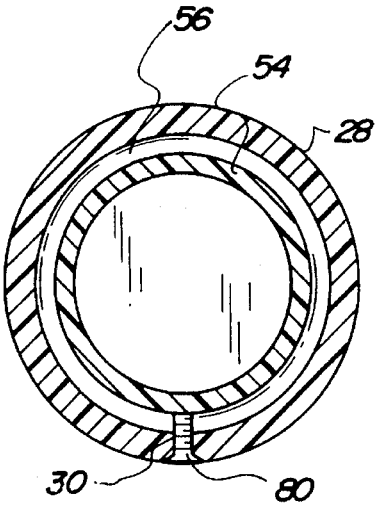

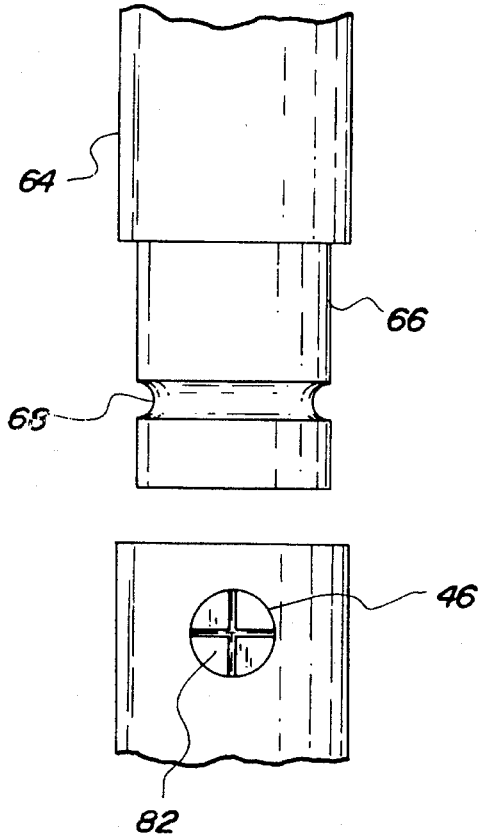
FIG. 5
FIG. 6
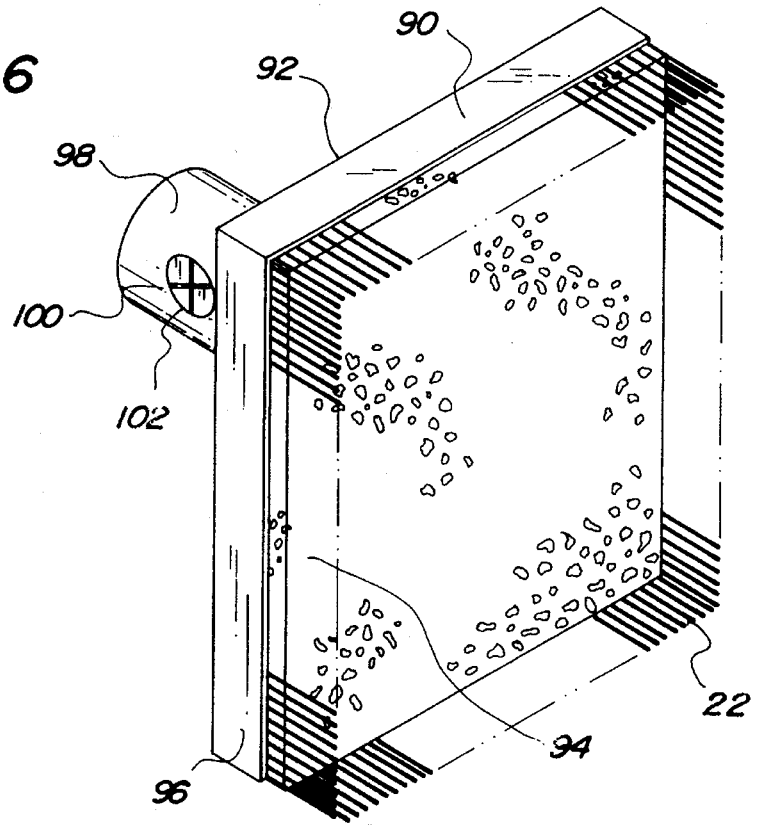

HEADLIGHT CLEANER WITH COMBINED SQUEEGEE AND BRUSH

BACKGROUND OF THE INVENTION

1. Field of the Invention

The present invention relates to a headlight cleaner and more particularly pertains to cleaning headlights of a vehicle with a headlight cleaner.

2. Description of the Prior Art

The use of headlight cleaners is known in the prior art. More specifically, headlight cleaners heretofore devised and utilized for the purpose of cleaning the headlights of a vehicle are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 298,072 to Stirling discloses a cleaning applicator with a swivel handle. U.S. Pat. No. 3,803,664 to Triplett discloses a windshield cleaner dispenser. U.S. Pat. No. 3,913,166 to Morrison discloses a headlight cleaning attachment. U.S. Pat. No. 3,934,301 to Di Salvo et al. discloses a device for cleaning the headlight glass on motor vehicles. U.S. Pat. No. 4,152,807 to Smahlik discloses a scrubbing attachment for a squeegee. U.S. Pat. No. 5,083,339 to Bristow discloses an apparatus for cleaning headlight lenses and similar surfaces.

While these devices fulfill their respective, particular objective and requirements, the aforementioned patents do not describe a headlight cleaner that provides a single tool that allows the headlights of a vehicle to be readily scrubbed with a brush and wiped clean with a squeegee.

In this respect, the headlight cleaner according to the present invention substantially departs from the conventional concepts and designs of the prior art, and in doing so provides an apparatus primarily developed for the purpose of cleaning headlights of a vehicle.

Therefore, it can be appreciated that there exists a continuing need for new and improved headlight cleaner which can be used for cleaning headlights of a vehicle. In this regard, the present invention substantially fulfills this need.

SUMMARY OF THE INVENTION

In the view of the foregoing disadvantages inherent in the known types of headlight cleaners now present in the prior art, the present invention provides an improved headlight cleaner. As such, the general purpose of the present invention, which will be described subsequently in greater detail, is to provide a new and improved headlight cleaner and method which has all the advantages of the prior art and none of the disadvantages.

To attain this, the present invention essentially comprises, in combination, a brush head. The brush head has a circular planar base plate with an upper surface, a lower surface, and a peripheral edge interconnecting the surfaces. The brush head also has a plurality of bristles extended perpendicularly outwards from the lower surface and a tubular neck with a lower extent coupled to the upper surface of the base plate and an upper extent with a threaded through hole formed thereon. An elongated rigid tubular brush handle is included. The brush handle has a tip end, a base end with a threaded through hole formed thereon, a 45 degree bend formed between the ends to thereby define a straight short segment adjacent to the base end and a straight long segment adjacent to the tip end, and a tubular coupler with a circumferential groove formed therearound axially extended from the tip end. The coupler of the brush handle is slidably disposed within the neck of the brush head with the corresponding through hole aligned with the groove.

An elongated rigid straight tubular squeegee handle is included. The squeegee handle has a tip end, a base end, and a tubular coupler with a circumferential groove formed therearound axially extended from the base end and with the coupler slidably disposed within the base end of the brush handle with the corresponding through hole aligned with the groove. An elongated squeegee is provided and perpendicularly coupled at its midpoint to the tip end of the squeegee handle. The squeegee has a central bracing component, an elongated sponge extended outwards from one side of the bracing component, and a flexible rubber blade extended outwards from an opposite side of the bracing component and with the blade further having a tapered edge formed thereon. Lastly, a pair of screws are included. One of the screws is threadedly disposed within the threaded through hole of the brush head and abutted against the groove of the brush handle to thereby couple the brush handle to the brush head. The other screw is threadedly disposed within the through hole on the base end of the brush handle and abutted against the groove of the squeegee handle to thereby couple the brush handle to the squeegee handle.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved headlight cleaner which has all the advantages of the prior art headlight cleaners and none of the disadvantages.

It is another object of the present invention to provide a new and improved headlight cleaner which may be easily and efficiently manufactured and marketed.

It is a further object of the present invention to provide a new and improved headlight cleaner which is of durable and reliable construction.

An even further object of the present invention is to provide a new and improved headlight cleaner which is susceptible of a low cost of manufacture with regard to both materials and labor, and which accordingly is then susceptible of low prices of sale to the consuming public, thereby making such a headlight cleaner economically available to the buying public.

Still yet another object of the present invention is to provide a new and improved headlight cleaner which provides in the apparatuses and methods of the prior art some of the advantages thereof, while simultaneously overcoming some of the disadvantages normally associated therewith.

Even still another object of the present invention is to provide a new and improved headlight cleaner for cleaning headlights of a vehicle.

Lastly, it is an object of the present invention to provide a new and improved headlight cleaner comprising a brush head; a brush handle having a tip end coupled to the brush head, a base end, and a bend therebetween to thereby define a straight short segment and a straight long segment; a straight squeegee handle having a tip end and a base end coupled to the base end of the brush handle; and an elongated squeegee coupled to the tip end of the squeegee handle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a plan view of the preferred embodiment of the present invention.

FIG. 4 is a cross-sectional view of the present invention taken along the line 4—4 of FIG. 3.

FIG. 5 is an exploded side-elevational view of the coupling between the squeegee handle and brush handle of the present invention.

FIG. 6 is an alternate embodiment of a brush head for use with the present invention.

The same reference numerals refer to the same parts through the various Figures.

DESCRIPTION OF THE PREFERRED EMBODIMENT

Figure 1:
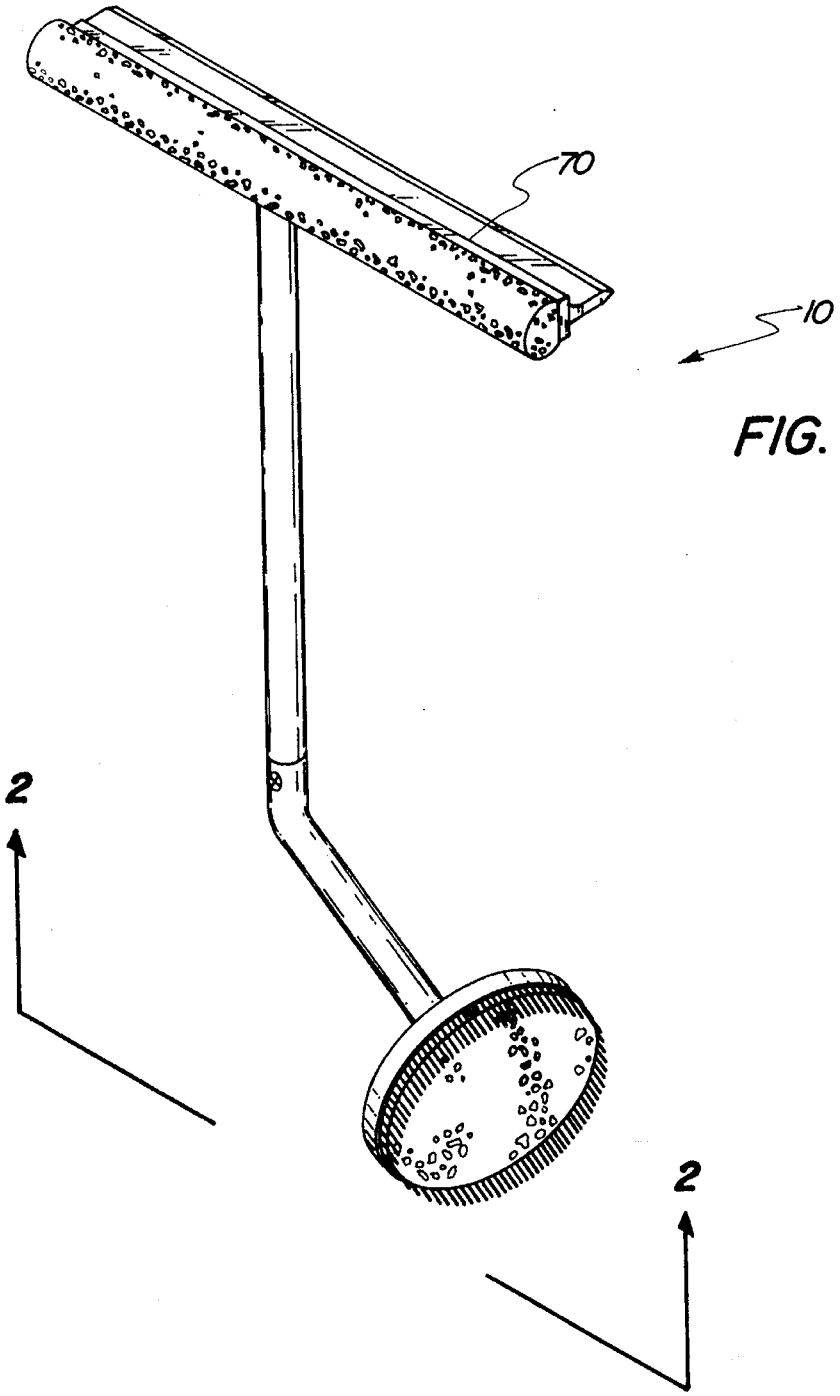
FIG. 1 is a perspective view of the preferred embodiment constructed in accordance with the principles of the present invention.

With reference now to the drawings, and in particular, to FIG. 1 thereof, the preferred embodiment of the new and improved headlight cleaner embodying the principles and concepts of the present invention and generally designated by the reference number 10 will be described.

The present invention is comprised of a plurality of components. In their broadest context, such components include a brush head, brush handle, squeegee handle, and squeegee. Such components are individually configured and correlated with respect to each other to provide the intended function of cleaning headlights on a vehicle.

Figure 2:
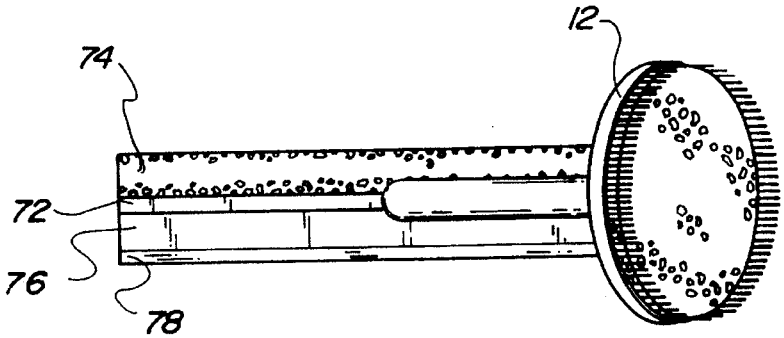
FIG. 2 is a side-elevational view of the present invention taken along the line 2—2 of FIG. 1.

Specifically, the present invention includes a brush head 12 as shown in FIG. 2. The brush head has a circular rigid planar base plate 14 with an upper surface 16, a lower surface 18, and a peripheral edge 20 interconnecting the surfaces. The brush head also includes a plurality of bristles 22 extended perpendicularly outwards from the lower surface. The bristles are formed of a generally flexible material. Furthermore, a tubular rigid neck 24 is included and has a lower extent 26 coupled to the upper surface of the base plate 14 and an upper extent 28 with a threaded through hole 30 formed thereon.

A brush handle 40 is also included. The brush handle is elongated, rigid, and tubular in structure. It has a tip end 42, a base end 44 with a threaded through hole 46 formed thereon, and a bend 48 formed between the ends. Preferably, the bend forms an angle of 45 degrees but can also be formed of an angle up to about 90 degrees. The bend thereby defines a straight short segment 50 and a straight long segment 52. The straight short segment is positioned adjacent to the base end 44. The straight long segment 52 is positioned adjacent to the tip end 42. The brush handle also includes a tubular coupler 54. The coupler has a circumferential groove 56 formed therearound as shown in FIG. 4. The coupler is coupled to and axially extended from the tip end 42 and slidably and snugly disposed within the upper extent 28 of the neck of the brush head 12. When positioned in this manner, the corresponding through hole 30 is aligned with the groove 56 of the coupler.

A squeegee handle 60 is provided. The squeegee handle is elongated, straight, and tubular in structure. It is formed of a rigid material such as plastic. The squeegee handle has a tip end 62, a base end 64, and a tubular coupler 66 with a circumferential groove 68 formed therearound. As best illustrated in FIG. 5, the coupler is coupled to and axially extended from the base end 64. The coupler is further slidably and snugly disposed within the base end 44 of the brush handle. When positioned in this manner, the corresponding through hole 46 of the brush handle is aligned with the groove 68 of the coupler 66.

An elongated squeegee 70 is perpendicularly coupled at its midpoint to the tip end 62 of the squeegee handle. The squeegee has a central rigid bracing component 72 that is integral with the tip end of the squeegee handle. The squeegee also includes an elongated sponge 74 with a generally oval cross-section. The sponge is coupled to and extended outwards from one side of the bracing component. The squeegee also includes a flexible rubber blade 76 extended outwards from an opposite side of the bracing component. The blade has a tapered edge 78 formed thereon for allowing wiping to be performed in an efficient manner.

Lastly, a pair of rigid screws are included. One of these screws 80 is threadedly disposed within the threaded through hole 30 of the brush head 12 and abutted against the groove 56 of the brush handle 40 to thereby couple the brush handle 40 to the brush head 12. The other screw 82 is threadedly disposed within the through hole 46 on the base end 44 of the brush handle and abutted against the groove 68 of the coupler 66 of the squeegee handle to thereby couple the brush handle 40 to the squeegee handle 60.

A second embodiment of the brush is shown in FIG. 6. In this embodiment of the brush, a square planar base plate 90 is included. The base plate has an upper surface 92, a lower surface 94, and a peripheral edge 96 interconnecting the surfaces. Like the brush of the preferred embodiment, this brush also has a plurality of bristles 22 coupled to and extended outwards from the lower surface of the base plate. In addition, a tubular neck 98 is extended from the upper surface of the base plate. The neck has a threaded through hole 100 disposed thereon with a screw 102 threadable therein for coupling the brush to the brush handle.

The present invention is utilized for cleaning the headlights of a vehicle. The present invention allows easy cleaning of recessed headlights or headlights that are formed in a grill of a vehicle. These headlights cannot be reached by conventional squeegee and sponge apparatuses currently available. The present invention has bristles of a length that allow the headlights to be readily scrubbed. The long bristles thus allow cleaning without removing a grill or other similar guards from a headlight. The angle formed between the handles allows the brush head or squeegee to be readily available for use through a simple turn of a user's wrist and further allows the user a firm grip for applying pressure upon an area of interest.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A headlight cleaner for cleaning headlights of a vehicle comprising, in combination:

a brush head having a circular planar base plate with an upper surface, a lower surface, and a peripheral edge interconnecting the surfaces, the brush head further having a plurality of bristles extended perpendicularly outwards from the lower surface and a tubular neck with a lower extent coupled to the upper surface of the base plate and an upper extent with a threaded through hole formed thereon;

an elongated rigid tubular brush handle having a tip end, a base end with a threaded through hole formed thereon, a 45 degree bend formed between the ends to thereby define a straight short segment adjacent to the base end and a straight long segment adjacent to the tip end, and a tubular coupler with a circumferential groove formed therearound axially extended from the tip end and with the coupler slidably disposed within the neck of the brush head with the corresponding through hole aligned with the groove;

an elongated rigid straight tubular squeegee handle having a tip end, a base end, and a tubular coupler with a circumferential groove formed therearound axially extended from the base end and with the coupler slidably disposed within the base end of the brush handle with the corresponding through hole aligned with the groove;

an elongated squeegee perpendicularly coupled at its midpoint to the tip end of the squeegee handle, the squeegee having a central bracing component with opposed sides, an elongated sponge extended outwards from one side of the bracing component, and a flexible rubber blade extended outwards from an opposite side of the bracing component and with the blade further having a tapered edge formed thereon; and a pair of screws with one of the screws threadedly disposed within the threaded through hole on the brush head and abutted against the groove of the brush handle to thereby couple the brush handle to the brush head and with the other screw threadedly disposed within the through hole on the brush handle and abutted against the groove of the squeegee handle to thereby couple the brush handle to the squeegee handle.

* * * * *